US006047578A

United States Patent [19]

Thieven

[11] Patent Number: 6,047,578

[45] Date of Patent: Apr. 11, 2000

[54] MULTI-STAND MANDREL-FREE STRETCH REDUCING MILL

[75] Inventor: Peter Thieven, Aachen, Germany

[73] Assignee: Mannesmann AG, Düsseldorf, Germany

[21] Appl. No.: 09/212,611

[22] Filed: Dec. 16, 1998

[30] Foreign Application Priority Data

Dec. 17, 1997 [DE] Germany ..... 197 58 107

[51] Int. Cl.[7] ..... B21B 37/68

[52] U.S. Cl. ..... 72/11.6; 72/8.9; 72/12.7; 72/224; 72/235

[58] Field of Search ..... 72/7.6, 8.9, 11.6, 72/12.7, 12.8, 224, 226, 234, 235

[56] References Cited

U.S. PATENT DOCUMENTS

| | | | |
|---|---|---|---|
| 3,952,570 | 4/1976 | Demny et al. | 72/224 |
| 4,099,402 | 7/1978 | Biller | 72/234 |
| 4,275,578 | 6/1981 | Steinbrecher et al. | 72/234 |
| 4,311,033 | 1/1982 | Demny et al. | 72/224 |
| 5,533,370 | 7/1996 | Kuroda et al. | 72/235 |
| 5,816,092 | 10/1998 | Pehle et al. | 72/224 |

*Primary Examiner*—Ed Tolan
*Attorney, Agent, or Firm*—Cohen, Pontani, Lieberman & Pavane

[57] ABSTRACT

A roll pass of a roll set having three rolls for a multi-stand mandrel-free stretch reducing mill has a roll pass shape that deviates from the circular. A tube is passed in its longitudinal direction through the non-circular roll pass shape enabling modification of a shape of a cross-section of the tube, so as to counteract the non-circular external diameter deviations of the tube. A final roll pass (finishing pass) of the stretch reducing mill is locally enlarged at peripheral points where the tube diameter of the entering tube would otherwise deviate downward from a target size and locally reduced in size at the peripheral points where the tube diameter would otherwise deviate upward from the target size.

6 Claims, 2 Drawing Sheets

MULTI-STAND MANDREL-FREE STRETCH REDUCING MILL

BACKGROUND OF THE INVENTION

1. Field of the Invention

The present invention relates to a multi-stand mandrel-free stretch reducing mill for reducing an external diameter of a tube. The stretch reducing mill includes a roll pass for roll sets, each of which has three rolls. The roll pass has a roll pass shape that deviates from the circular, takes into account the modification of the shape of a cross-section of a tube, and counteracts a non-circular external diameter of the tube.

2. Description of the Related Art

It is known in the prior art in stretch reducing mills to use roll pass shapes that have contours deviating from the circular. These deviations have different purposes, e.g., to prevent material from entering a gap between rolls and causing surface damage to a rolled material. The deviations are also meant to minimize wear on the rolls in the region of roll flanks.

Moreover, roll pass shapes deviating from circular are used, depending on diameter reduction and wall thickness/diameter ratio of the rolled material, to avoid the formation of irregular shapes in an interior of the rolled material. In practice, to avoid this internal polygon formation, as it is called, non-circular roll passes with a wide variety of roll pass shapes have been proposed, as described above.

In contrast, exactly round rolls have generally been used until now for finish-rolling of tubes in a final finishing pass or passes of the stretch reducing mill (wherein an amount of heat-related shrinkage is taken into account as needed). However, it has been found that such finish-rolled tubes, upon leaving the stretch reducing mill, have external diameter fluctuations of up to 0.3% to 0.5% of their average diameter. These fluctuations occur due to non-uniform modification of the shape of a cross-section of the rolled material.

SUMMARY OF THE INVENTION

An object of the present invention is to provide a roll pass for a generic stretch reducing mill for rolling tubes in such a way that constancy of an external diameter of a finish-rolled tube is improved. The roll pass of the present invention exerts local influences on material flow in the tube during a reduction process so that a smaller deviation in the tube diameter occurs locally at critical points along the periphery of the tube.

To attain this object, according to the present invention final roll passes (finishing passes) of the stretch reducing mill are enlarged locally at points in contact with the periphery of the tube where the tube diameter would otherwise be expected to deviate downward from a target size. Conversely, the final roll passes are made smaller locally at the points in contact with the peripheral of the tube where the tube diameter would otherwise to be expected to deviate upward from the target size.

Studies have shown that non-circularity of the external shape of the rolled tube consists essentially of two parts, namely, a two-sided oval contour and a three-sided (or, in some cases, a six-sided) oval contour. These defective shapes can occur in the finish-rolled tube individually or in reciprocal superimposition. In most cases, the positions of these diameter deviations are not random, but rather are reproduced in relation to the roll passes of final roll stands.

The diameter deviations are therefore regular in nature, meaning that the positions of the diameter deviations on the tube recur from one tube to a next tube. These diameter deviations or defects can result for example from distortion of the tubes due to uneven cooling while being rolled. Other possible causes of deviation include tube center deflection from a theoretical roll pass center during rolling due to worn stand seatings and roller bearings, or inadequate adjustment of the roll passes (usually three-sided oval roll passes) located before the final roll passes.

In a further embodiment of the present invention that, for the purpose of evening out the tube cross-section in the case of two-sided or multilateral tube ovality, a locally reduced (or enlarged) peripheral point of the roll pass is arranged opposite to a peripheral point of the respective expected enlargement (or reduction) in the tube diameter. In this way, the non-circularity of the finished tube is counteracted from the start, and the result is the desired improvement in tube diameter constancy.

In another advantageous embodiment of the present invention a manual or automatic measurement device is provided for the purpose of continuously detecting the local tube diameter. Data from the measurement device is then supplied to a database and statistically analyzed so as, to determine the deviations from the circular and process the roll contours accordingly.

According to yet another advantageous further embodiment of the present invention, the measured values are supplied to a CNC-controlled tool machine for machined local adjustments of a theoretical final caliber.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1A:
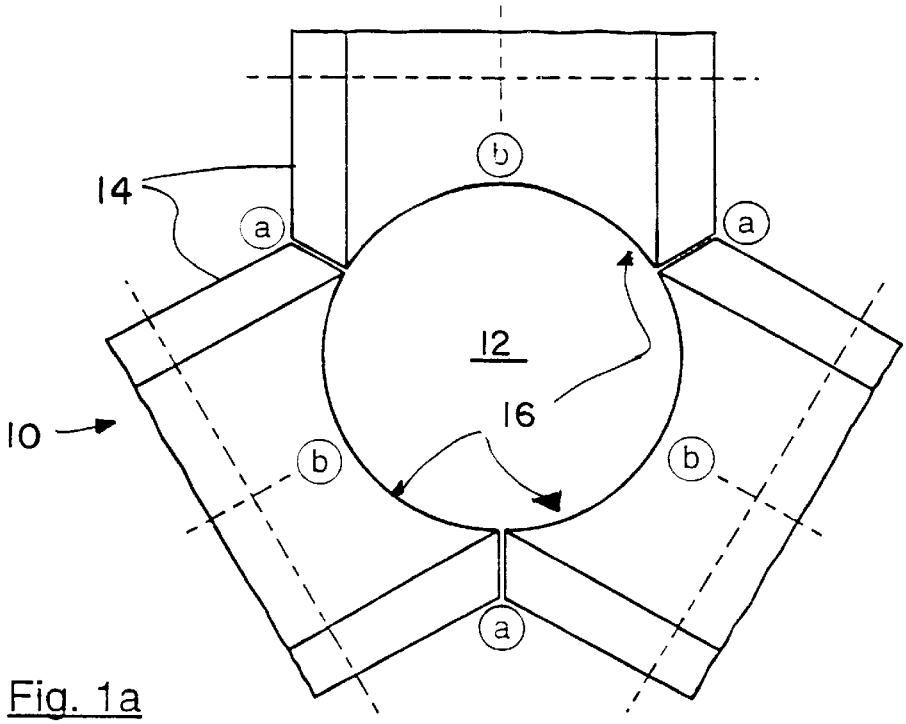
FIG. 1*a* shows a sectional view of a three-roll roll pass of a stretch reducing mill, with a round roll pass shape.
Figure 1B:
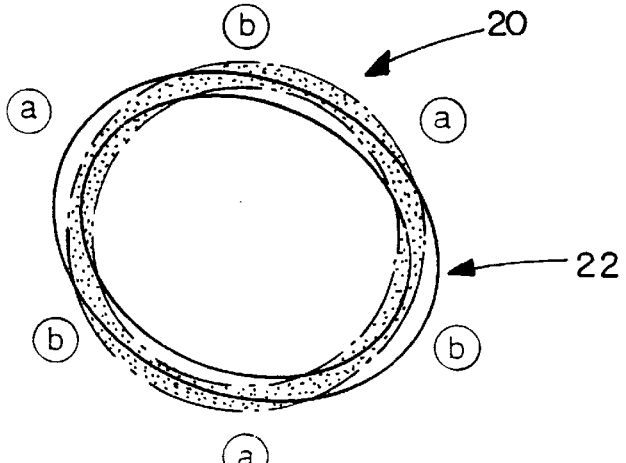
FIG. 1*b* shows a non-circular tube in cross-section, with a two-sided oval contour.
Figure 1C:
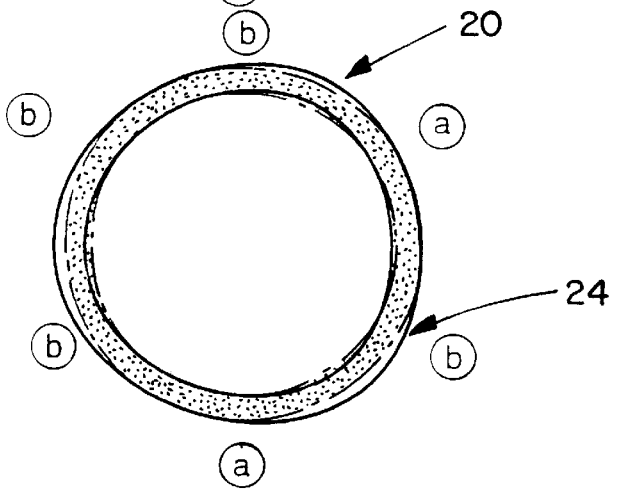
FIG. 1*c* shows a non-circular tube in cross-section, with a three-sided oval contour.

FIG. 1*a* shows a sectional view of a three-roll roll pass 10 with a round roll pass shape 12, as is typical for a final stand of a stretch reducing mill. The roll pass 10 comprises three rollers 14 which are arranged proximal one another. Inner surfaces 16 of the rollers 14 are configured so as to define the roll pass shape 12. A tube 20 is passed along its longitudinal direction through the roll pass 10 so that an external surface of the tube 20 is in contact with the inner surfaces 16 of the rollers 14. Ideally, therefore, the roll pass shape 12 corresponds to the external shape of the tube 20. The characteristic positions a for roll pass discontinuity and b for the roll pass center or roll pass base are indicated in the roll pass 10. Although the roll pass 10 is typically circular, the finished tube 20 is usually not exactly round. Studies show that non-circularity of the external shape of the rolled tube 20 consists essentially of two parts, namely a two-sided oval contour 22, as shown in FIG. 1*b* in solid lines, and a three-sided oval contour 24, as shown in solid lines in FIG. 1*c* (in some cases, this contour is a six-sided oval). An ideal circular contour is shown in gray in FIGS. 1*b* and 1*c*.

Shape defects in the finished tube appear individually or in reciprocal superimposition. The position of external diameter deviations such as the two-sided and three-sided oval contours 22, 24, is usually not random from tube to tube, but rather is reproducible relative to the positions a and b of the roll pass 10.

The positions of the external diameter deviations are regular in nature and are determined by an automatic or a manual measurement device which sends data to an analyzing device for analysis. The analyses data is then supplied to a device such as a CNC-controlled tool machine which suitably configures the roll pass 10 so as to prevent non-circular tube shapes 22, 24 that would otherwise occur.

Figure 2A:
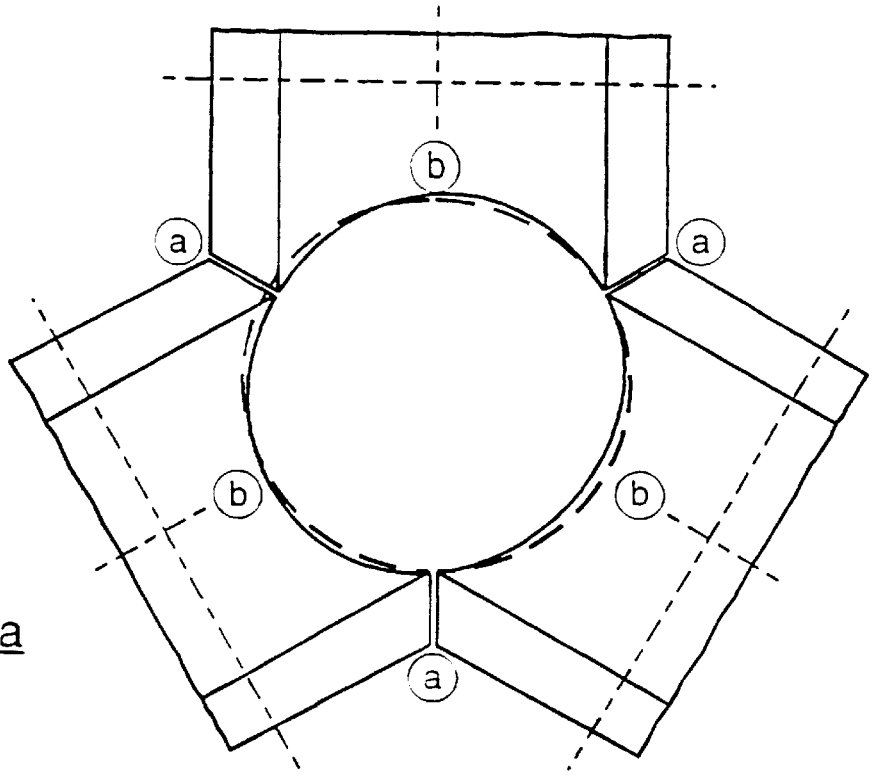
FIG. 2*a* shows a sectional view of the roll pass according to the present invention, in the case of the two-sided oval contour as in FIG. 1*b.
Figure 2B:
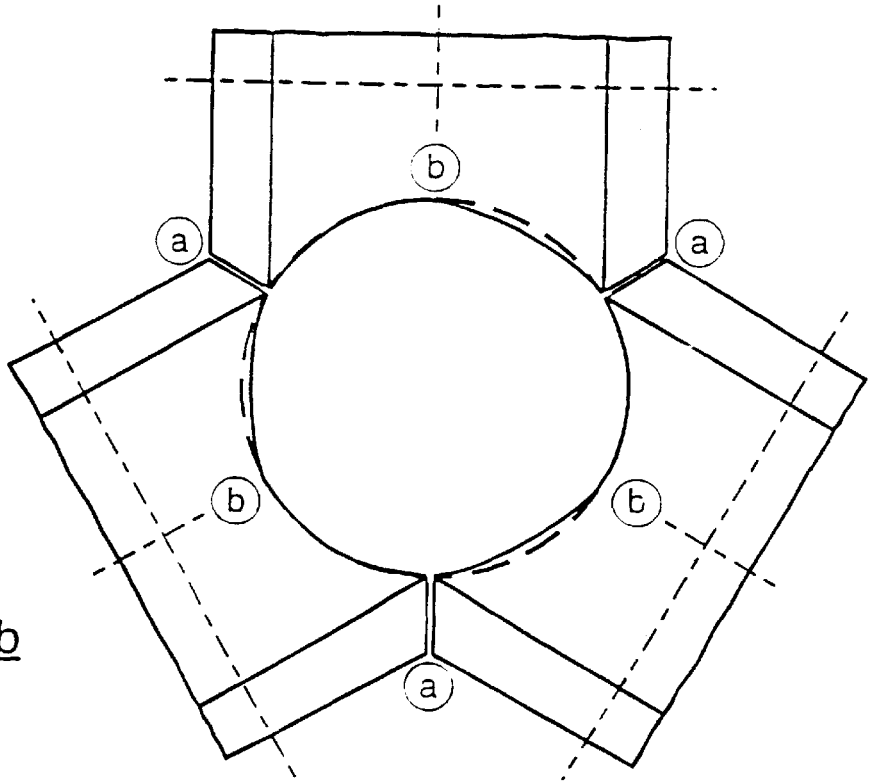
* and FIG. 2*b* shows a sectional view of the roll pass according to the present invention, in the case of multilateral external diameter deviations as in FIG. 1*c*.

FIGS. 2*a* and 2*b* show suitable roll pass configurations according to the present invention. In FIG. 2*a,* the roll pass configuration counteracts the two-sided oval contour 22, while in FIG. 2*b* the roll pass configuration counteracts the three-sided oval contour 24. In both cases external deviations in the tube diameter are compensated for by locally respectively enlarging and reducing in size the roll passes, so that an exactly round tube can be expected as a result.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A multi-stand, mandrel-free stretch reducing mill for reducing an external diameter of a tube to a target size, comprising:

multiple roll stands; and three rolls arranged in each of the roll stands so as to form a respective roll pass, each of the rolls having a peripheral side arranged at an inside of the roll pass so as to be contactable with the external diameter of the tube and so that the three rollers define a cross-sectional roll pass shape that deviates from a circular configuration so as to modify a cross-section of the tube to counteract a non-circular external tube diameter, the rolls in one of the roll stands forming a final roll pass, the rolls in the final roll pass being configured to form a final roll pass shape that is locally enlarged at peripheral points where the external diameter of the tube would be expected to deviate downward from the target size, and is locally reduced at peripheral points where the external diameter of the tube would be expected to deviate upward from the target size.

2. The multi-stand mandrel-free stretch reducing mill as in claim 1, wherein a locally enlarged peripheral point of the roll pass shape lies opposite to the expected reduced tube diameter, and a locally reduced peripheral point of the roll pass shape lies opposite to the expected enlarged tube diameter, so as to even out the tube cross-section, when one of a two-sided and multilateral tube ovality is present.

3. The multi-stand mandrel-free stretch reducing mill as in claim 1, further comprising measurement means for continuously determining local tube diameter data, and database means for receiving and statistically analyzing the data.

4. The multi-stand mandrel-free stretch reducing mill as in claim 3, further comprising CNC-controlled tool means for selectively locally enlarging and reducing in size the final roll pass, in dependence upon the data from the measurement means.

5. The multi-stand mandrel-free stretch reducing mill as in claim 3, wherein the measurement means is an automatic measurement device.

6. The multi-stand mandrel-free stretch reducing mill as in claim 3, wherein the measurement means is a manual measurement device.

* * * * *